United States Patent [19]

Sukhraj

[11] 4,137,589

[45] Feb. 6, 1979

[54] SCOURING DEVICE

[76] Inventor: Sukhnandan Sukhraj, 48-50 38 St., Long Island City, N.Y. 11101

[21] Appl. No.: 835,423

[22] Filed: Sep. 21, 1977

[51] Int. Cl.[2] ..... A46B 13/02

[52] U.S. Cl. ..... 15/28; 51/170 T

[58] Field of Search ..... 15/3.53, 23, 24, 28, 15/29; 128/56; 32/58; 192/66; 51/170 T; 173/13

[56] References Cited

U.S. PATENT DOCUMENTS

| | | | |
|---|---|---|---|
| 766,182 | 8/1904 | Hale | 15/23 |
| 1,698,952 | 1/1929 | Hoover | 15/128 X |
| 1,891,470 | 12/1932 | Errington et al. | 15/23 |
| 2,161,300 | 6/1939 | Kolstad | 192/66 X |
| 2,904,804 | 9/1959 | Odessey | 15/23 X |
| 3,024,883 | 3/1962 | Eriksson | 15/28 |
| 3,106,732 | 10/1963 | Dayton et al. | 15/28 |
| 3,312,994 | 4/1967 | Fassio | 15/28 X |

FOREIGN PATENT DOCUMENTS

| | | | |
|---|---|---|---|
| 521447 | 7/1921 | France | 192/66 |

*Primary Examiner*—Edward L. Roberts

*Attorney, Agent, or Firm*—C. Bruce Hamburg

[57] ABSTRACT

A scouring device comprising a stationary housing having a motor therein, an electrical connector extending from the motor for connection to a power source, a flexible drive shaft extending from the housing and at a first end of the shaft connected to the motor, a mobile housing connected to a second end of the shaft, the mobile housing having a first member mounted therein and fixed to the shaft and adapted to rotate therewith and a second member mounted therein and axially spaced from the first member and in alignment with the first member, a spring biasing the second member to a position removed from the first member, and complementary connection structure on the first and second members adapted to interconnect with each other, whereby to transmit rotation of the flexible shaft to the second member.

6 Claims, 2 Drawing Figures

SCOURING DEVICE

BACKGROUND OF THE INVENTION

1. FIELD OF THE INVENTION

This invention relates to power driven scouring devices, and is directed more particularly to a scouring device for pots and the like.

2. DESCRIPTION OF THE PRIOR ART

Power driven dishwashing devices are known in the art generally. Examples of such devices may be found in U.S. Pat. No. 1,633,800 issued June 28, 1927 to F. A. Wilcox; U.S. Pat. No. 1,745,323 issued Jan. 28, 1930 to B. S. Coe et al.; U.S. Pat. No. 2,084,704 issued June 22, 1937 to E. L. Pohl; U.S. Pat. No. 2,944,271 issued July 12, 1960 to E. C. Foster et al.; U.S. Pat. No. 3,026,552 issued Mar. 27, 1962 to J. C. Price; U.S. Pat. No. 3,378,869 issued Apr. 23, 1968 to T. F. Schwartz; U.S. Pat. No. 3,715,770 issued Feb. 13, 1973 to C. F. Obregon-Gomez; and U.S. Pat. No. 3,806,980 issued Apr. 30, 1974 to L. Velsito.

In spite of the above advances, there exists a need for an inexpensive, reliable, convenient and easy to operate power driven means for assisting in the cleaning of pots and pans in kitchens of private residences, restaurants, and the like.

SUMMARY OF THE INVENTION

An object of the present invention is to provide a scouring device which is relatively simple in design and therefore inexpensive to manufacture.

A further object of the invention is to provide such a device as is convenient and easy to operate and effective in scouring of pots and the like.

With the above and other objects in view, as will hereinafter appear, a feature of the present invention is the provision of a scouring device comprising a stationary housing having a motor therein, an electrical connection means extending from the motor for connection to a power source, a flexible drive shaft extending from the housing and at a first end of the shaft connected to the motor, a mobile housing connected to a second end of the shaft, the mobile housing having a first member mounted therein and fixed to the shaft and adapted to rotate therewith and a second member mounted therein and axially spaced from the first member and in alignment with the first member, spring means biasing the second member to a position removed from the first member, and complementary connection means on the first and second members adapted to interconnect with each other, whereby to transmit rotation of the flexible shaft to the second member.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

DESCRIPTION OF THE DRAWINGS

Reference is made to the accompanying drawings in which is shown an illustrative embodiment of the invention from which its novel features and advantages will be apparent.

DESCRIPTION OF THE PREFERRED EMBODIMENT

Figure 1:
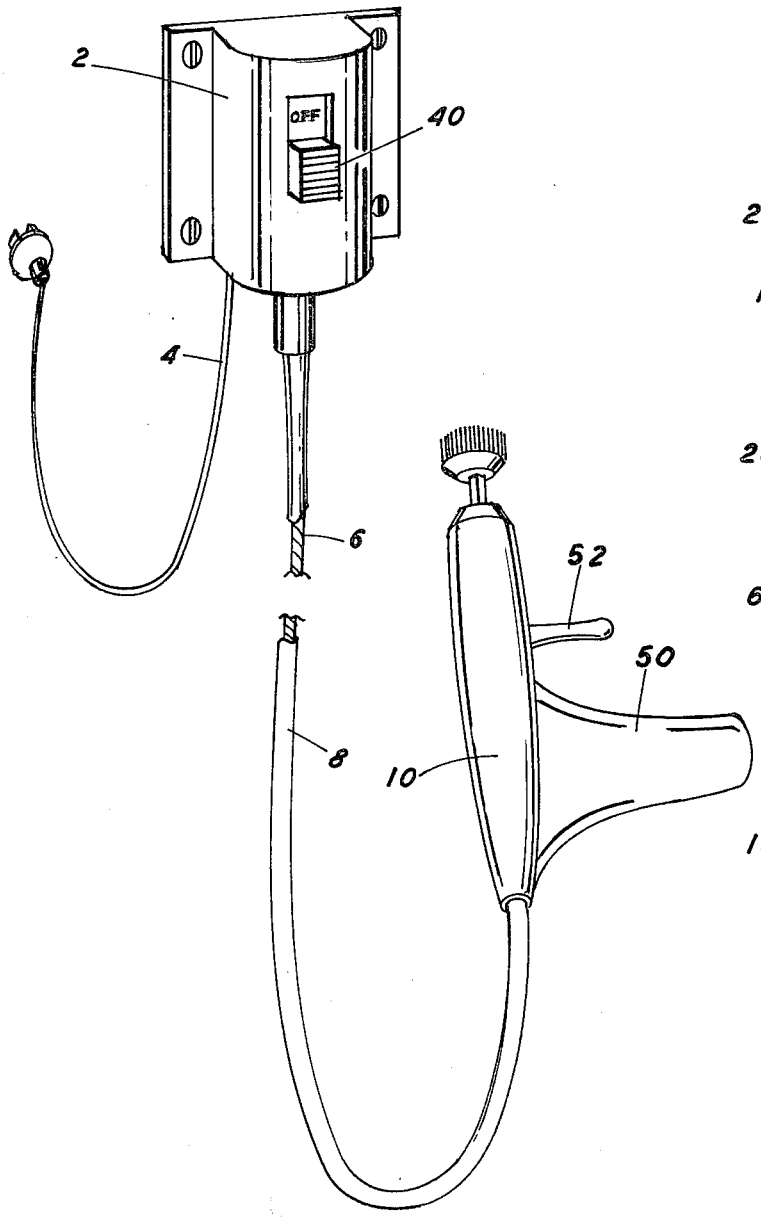
FIG. 1 is a perspective view of one form of scouring device illustrative of an embodiment of the invention.

Referring to the drawings, it will be seen that the illustrative device includes a stationary housing 2 having a motor therein (not shown) and an electrical connection means 4 extending from the motor for connection to a power source. A flexible drive shaft 6 extends from the housing 2 and at a first end of the shaft is connected to the motor within the housing. The shaft 6 is covered by a flexible sheath 8.

Figure 2:
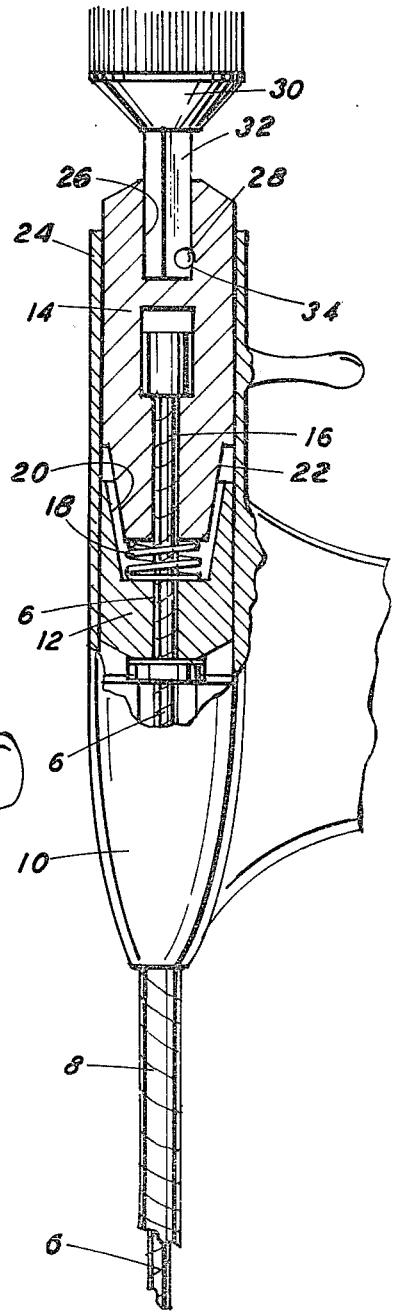
FIG. 2 is a side elevational view, partly broken away, showing a portion of the device of FIG. 1.

A mobile housing 10 is connected to the other end of the flexible shaft 6, as shown in the drawings. The mobile housing 10 has a first member 12 mounted therein to which the flexible shaft 6 is fixed. The mobile housing 10 further includes a second member 14 mounted therein and axially spaced from the first member 12. The second member 14 has disposed therein an extension 16 of the drive shaft 6 which is anchored in the second portion 14 but not fixed thereto, so that the second portion 14 does not move with the rotation of the shaft extension 16. A spring means 18 biases the second member 14 to a position removed from the first member 12, as shown in FIG. 2. The first and second members 12, 14 are respectively provided with complementary connection means 20, 22 adapted to interconnect with each other, whereby to transmit rotational movement of the flexible shaft 6 and the first member 12 to the second member 14.

The mobile housing 10 includes a sleeve 24 in which are rotatively disposed the first and second members 12, 14 and in which the second member 14 is axially movable in response to and in opposition to the force of the spring 18. The second member 14 is axially movable between a first position in which the first and second portions are separated, as shown in FIG. 2, and a second position in which the complementary connection means 20, 22 are engaged.

Preferably, the spring means 18 comprises a coil spring, as shown in FIG. 2, disposed between the first and second members 12, 14.

The second member 14 has on an end thereof a recess 26 having a lock means 28, such as a snap catch or a spring biased ball therein.

A scrubber device 30 is provided having a shank portion 32 extending therefrom, the shank portion 32 having a lock means 34 thereon, such as a recess for reception of a catch or a spring biased ball. The lock means 28, 34 operate to secure the scrubber device 30 to the second member 14. Once secured, the scrubber device 30 is adapted to rotate with the second portion 14 and to move axially therewith. The scrubber means 30 preferably comprise a number of alternative attachments usable with the device. For example, a brush type device, as shown in the drawings, may be used, but also any number of scrubber devices having steel wool surfaces thereon, or nylon scrubber surfaces, or any of many known such contrivances would be suitable.

The device is provided with an electrical switch means 40 which is disposed electrically between the motor in the housing 2 and the electrical connector means 4. In the embodiment shown and described, the switch means 40 is disposed on the stationary housing 2. The electrical lead 4 may comprise a permanent connection to the circuit of a building, or alternatively, as shown in FIG. 1, may comprise a simple electrical lead having a plug adapted for insertion into an ordinary household outlet. The housing 2 is preferably mounted on a wall surface in the vicinity of a dishwashing station, as for example, close by a kitchen sink.

The mobile housing 10 is preferably provided with a hand grip 50 and a finger grip 52 which in combination provide the operator with easy and convenient means for handling the mobile housing. If desired, the finger grip 52 may be omitted and the device controlled by manipulation of the hand grip 50.

In operation on pots and pans, and the like, an operator would first throw the switch means 40 to an "ON" position to energize the motor and thereby cause rotative movement of the flexible drive shaft and the first portion 12 within the sleeve 24. The operator would then engage the utensil to be cleaned with the scrubber device 30. Pressure upon the scrubber device 30 causes sliding movement of the second member 14 against the pressure of the spring 18 and toward the first member 12. Upon interengagement of the complementary connector means 20, 22 the second member 14 will rotate with the first member 12, thereby providing rapid rotational movement of the scrubber device 30. Release of pressure by the operator on the utensil being cleaned, will permit the second member 14 to slide in response to the spring 18 back to a position in which the complementary connector means 20, 22 are disengaged, whereby the rotative movement of the second member 14 and the scrubber device 30 ceases. Thus, it is not necessary that the operator manipulate the switch means 40, the mobile housing being operative to energize and de-energize the scrubber device 30 as desired.

It is to be understood that the present invention is by no means limited to the particular construction herein disclosed and/or shown in the drawings, but also comprises any modifications or equivalents within the scope of the disclosure.

Having thus described by invention what I claim as new and desire to secure by Letters Patent of the United States is:

1. A scouring device comprising a stationary housing having a motor therein, an electrical connection means extending from said motor for connection to a power source, a flexible drive shaft extending from said housing and at a first end of said shaft connected to said motor, a mobile housing, said mobile housing having a first member mounted therein and fixed to said shaft and adapted to rotate therewith and a second member axially spaced from said first member and in alignment with said first member, said second member being axially slidable in said housing and having means for receiving and retaining a scrubber means at a free end thereof, said shaft having an extension extending into said second member and having means thereon for retaining said second member in said housing, said shaft being rotatable relative to said second member, spring means biasing said second member to a position axially spaced from said first member, and complementary connection means on said first and second members adapted to interconnect with each other, whereby to transmit rotation of said flexible shaft to said second member.

2. The invention in accordance with claim 1 in which said receiving and retaining means includes a recess and a lock means disposed in said recess.

3. The invention in accordance with claim 2 including scrubber means having a shank thereon and adapted to fit in said recess, said shank having complementary lock means thereon engageable with said recess lock means for securing said scrubber to said second member.

4. The invention in accordance with claim 1 including electrical switch means for electrically interconnecting said power source and said motor.

5. The invention in accordance with claim 4 in which said switch means is disposed on said stationary housing.

6. The invention in accordance with claim 1 in which said spring means comprises a coil spring disposed between said first and second members.

* * * * *